US005680935A

United States Patent [19]

Mistander et al.

[11] Patent Number: 5,680,935

[45] Date of Patent: Oct. 28, 1997

[54] ARRANGEMENT FOR THE INFEED AND OUTFEED OF VALUABLE DOCUMENTS

[75] Inventors: Jan Mistander, Kinmanssonsvägen; Jan Wigur, Brännkyrkagatan; Gösta Edin, Orrstigen; Jan Olof Ek, Långpannestigen; Leif Lundblad, Djurgårdsslätten; Bertil Mattsson, Kvistgränd, all of Sweden

[73] Assignee: De la Rue Inter Innovation AB, Flen, Sweden

[21] Appl. No.: 623,971

[22] Filed: Mar. 29, 1996

[30] Foreign Application Priority Data

Mar. 31, 1995 [SE] Sweden ..... 9501180

[51] Int. Cl.[6] ..... B07C 5/00

[52] U.S. Cl. ..... 209/534

[58] Field of Search ..... 209/534; 271/3.01, 271/216, 163; 270/52.13; 194/206, 207

[56] References Cited

U.S. PATENT DOCUMENTS 5,064,074 11/1991 Edin et al. ..... 209/534
5,533,627 7/1996 Nordqvist ..... 209/534

FOREIGN PATENT DOCUMENTS

409809A1 1/1991 European Pat. Off. .
WO9310511 5/1993 WIPO .

*Primary Examiner*—David H. Bollinger
*Attorney, Agent, or Firm*—Donald R. Schoonover

[57] ABSTRACT

An arrangement for infeeding and outfeeding documents, such as banknotes, cheques, etc., having a command system for externally controlling the functions thereof, and a storage system for storing the documents fed into the arrangement between mutually coacting belts. The storage system has allocated, well-defined and registered document storage positions for incoming documents. A detector system functions to identify incoming documents prior to storage of the documents in the well-defined and unoccupied positions. The arrangement also includes a memory system for storing information relating to respective locations of stored documents, and a path selector mechanism which, when in a first position, enables the documents to be fed to the storage system and which, when in a second position, enables, in accordance with information obtained from the memory system, the documents earlier stored in the document storage system to be dispensed from the arrangement in response to a command entered through the command system. This enables the arrangement to receive a mixture of different documents on each infeed occasion and to dispense on each outfeed occasion a desired quantity and desired type of documents pre-selected through the command system.

10 Claims, 2 Drawing Sheets

ARRANGEMENT FOR THE INFEED AND OUTFEED OF VALUABLE DOCUMENTS

CROSS REFERENCE TO EARLIER APPLICATION

Claiming benefit under 35 U.S.C. § 119, this application is a U.S. counterpart of Swedish Patent Application No. 9501180-5, filed Mar. 31, 1995.

INCORPORATION BY REFERENCE

Swedish Patent Application No. 9501181-3 filed Mar. 31, 1995, and a U.S. counterpart thereof entitled "AN ARRANGEMENT FOR CORRECTLY FEEDING THIN OBJECTS, SUCH AS BANKNOTES, CHEQUES, ETC." and filed concurrently herewith on Mar. 29, 1996 as application Ser. No. 08/624,303, are hereby incorporated herein reference in their entirety, including drawings thereof.

BACKGROUND OF THE INVENTION

1. Field of the Invention

The present invention relates to an arrangement for the infeed and outfeed of valuable documents, such as banknotes, cheques, etc.

2. Description of the Related Art

Banknote depositing arrangements, sometimes referred to as "infeed", and banknote withdrawal arrangements, sometimes referred to as "outfeed", are known in the art. Also known in the art are arrangements for combined deposit and withdrawal of banknotes. Such arrangements normally include cassettes or boxes wherein banknotes are fed into one end thereof and fed out from the other end thereof. These latter arrangements are relatively complicated and bulky, and therefore are generally expensive to produce and use.

Also known in the art are banknote storage arrangements in which banknotes are stored between the turns of coiled belts. These arrangements, however, have not been widely used because their function has not be found to be sufficiently flexible or precise.

What is needed is an arrangement that avoids the aforesaid drawbacks and limitations while greatly facilitating infeeding and outfeeding of documents, including banknotes of mixed denominations.

SUMMARY OF THE INVENTION

An improved arrangement is provided for facilitating infeeding and outfeeding of documents, including banknotes of mixed denominations. The system includes storage means for the storage of thin or valuable documents fed into the arrangement from without or externally into allocated well-defined and registered document storage positions or stations intended for incoming or infed documents, and detector means on the input side of the arrangement for identifying the incoming of infed thin or valuable documents prior to storage of the documents in the well-defined but unoccupied positions of stations of the storage means.

The arrangement also includes memory means for storing information relating to respective positions or stations of incoming or infed documents in the storage means and a processor for storing in the memory means information received from the detector means and also information relating to the well-defined position or station in which a thin or valuable document is stored. The arrangement also includes path selector means which, when in a first position, enables thin or valuable documents to be fed to the storage means and which, when in a second position, enables, in accordance with information obtained from the memory means, thin or valuable documents earlier or previously stored in the document storage means to be dispensed from the arrangement in response to a command entered through a command means.

The system is able or structured to receive a mixture of different thin or valuable documents on each depositing or infeeding occasion and to dispense a desired type or types of documents in desired quantities, as ordered or requested through the command means.

Therefore, the principal objects and advantages of the present invention include facilitating infeeding and outfeeding of documents, including banknotes of mixed denominations.

Other principal objects and advantages of the present invention will become apparent from the following description taken in conjunction with the accompanying schematic drawings wherein are set forth, by way of illustration and example, certain embodiments of the present invention.

DETAILED DESCRIPTION OF THE INVENTION

Figure 1:
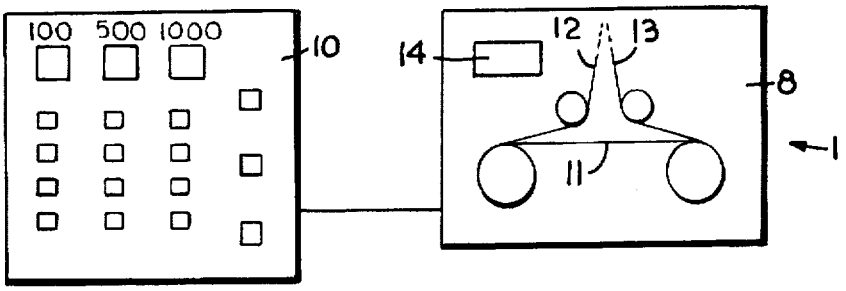
FIG. 1 is a schematic representation of an arrangement for the infeed and outfeed of valuable documents, illustrating various units thereof such as command means and storage means, according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for teaching one skilled in the art to variously employ the present invention in virtually any appropriately detailed structure.

The reference numeral 1 generally refers to an arrangement for the infeed and outfeed of valuable or thin documents, such as banknotes, cheques, etc., in accordance with the present invention, as schematically shown in FIGS. 1 through 4. The arrangement 1 includes command means 10, by which functions of the arrangement 1 are externally controlled; storage means 8, which includes mutually co-acting belts 11, 12 and 13 between which deposited thin or valuable documents, such as banknotes, are stored; a process module 41; a pre-storage module 42; a main storage module 43; and a cassette module 44.

Figure 2:
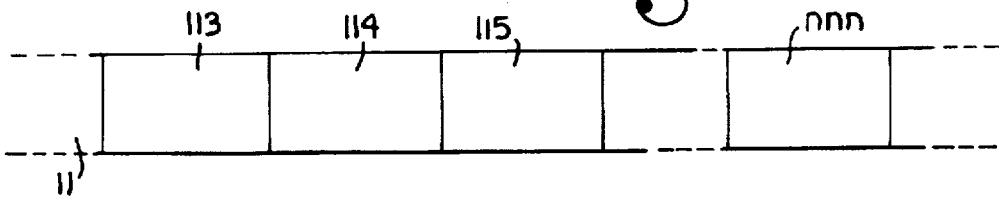
FIG. 2 is a partial schematic representation of the arrangement for the infeed and outfeed of valuable documents, illustrating belts having storage positions or stations thereof.

The storage means 8 also includes a plurality, one thousand for example, of well-defined storage positions or stations 113, 114, 115, . . . , nnn, etc., as indicated in FIG. 2, for receiving externally deposited banknotes, one banknote in each position or station. The arrangement 1 also includes a memory 14 wherein information relating to deposited banknotes is stored, e.g. the value or denomination of each banknote stored in respective positions or stations such as SEK 100 in station 113, SEK 1,000 in station 114, SEK 500 in station 115, etc.

FIG. 2 illustrates a small piece or section of the storage belt 11 of the storage means 8. The belt 11 has numerous well-defined storage positions or stations, some of which are referenced here as positions or stations 113, . . . , etc. For example, the belt 11 may contain as many as one thousand or more of the positions or stations 113, etc.

Figure 3:
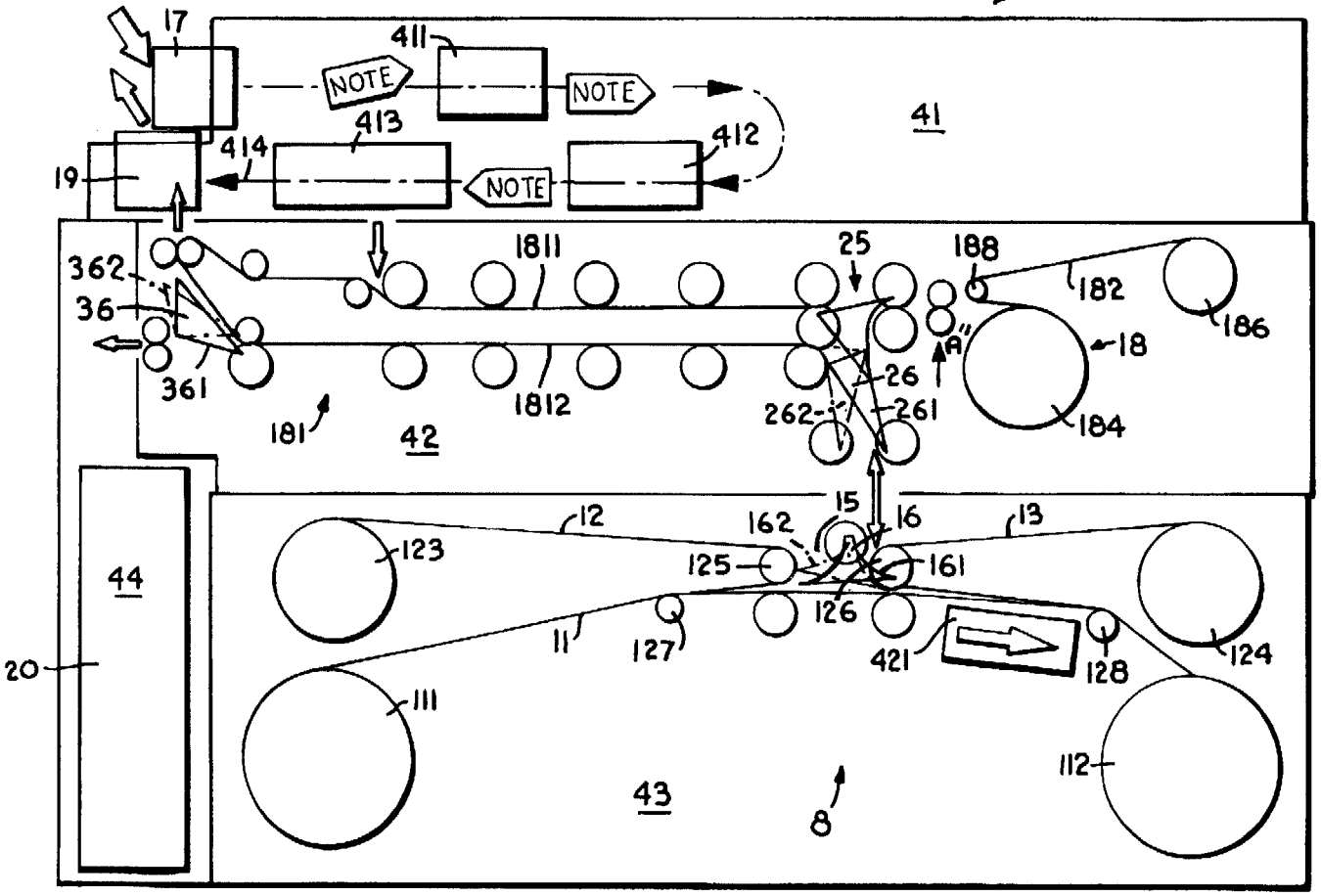
FIG. 3 is a schematic representation of the arrangement for the infeed and outfeed of valuable documents, illustrating construction or structure of the storage means in greater detail.

As shown in FIG. 3, the storage means 8 comprises the belt 11, sometimes referred to herein as the first belt 11, which is coiled onto and uncoiled from a first belt reel 111 and uncoiled from and coiled onto a second belt reel 112, depending on the outfeed or infeed of banknotes, respectively. The storage means 8 further includes the belt 12, sometimes referred to herein as the second belt 12, which is adapted to be coiled onto and uncoiled from the first belt reel 111 together with the first belt 11, and the belt 13, sometimes referred to herein as the third belt 13, which is adapted to be uncoiled from and coiled onto the second belt reel 112 together with the first belt 11.

The second belt 12 and the third belt 13 together form an inner banknote infeed/outfeed opening 15 in which there is arranged a multi-position path selector means 16 which, when in a first position, as indicated by the solid lines designated by the numeral 161 in FIG. 3, enables incoming banknotes to be stored between the first belt 11 and the third belt 13 on the second belt reel 112 as a leading edge of the incoming banknotes pushes the selector means 16 to one side, and when in a second position, as indicated by the dotted lines designated by the numeral 162 in FIG. 3, enables banknotes to be dispensed from their storage positions or stations between the first belt 11 and the third belt 13 on the second belt reel 112. When the path selector means 16 is in the first position 161, banknotes can also be transferred from or to the first belt reel 111 while positioned between the belts 11 and 12 and to or from the second belt reel 112 while positioned between the belts 11 and 13.

The belt 11 can thus be reeled onto and unreeled from the first belt reel 11 and reeled onto and unreeled from the second belt reel 112.

The belt 12 can be reeled onto and unreeled from the first belt reel 111 together with the first belt 11, and unreeled from and reeled onto a third belt reel 123 over two intermediate guide rollers 125 and 127.

The belt 13 can be reeled onto and unreeled from the second belt reel 112 together with the first belt 11, and unreeled from and reeled onto a fourth belt reel 124 over two intermediate guide rollers 126 and 128.

The infeed and outfeed of banknotes is thus effected to and from the second belt reel 112, respectively, whereas the transfer of banknotes is effected in both directions between the belt reels 111 and 112.

Between the externally accessible infeed or deposit opening 17 and the storage means 8 is located a pre-storage means 18, whose capacity is generally much smaller than the capacity of the storage means 8. For example, the pre-storage means 18 may have a capacity to store approximately twenty banknotes. When banknotes are fed into the arrangement 1 and subsequently straightened and sensed as hereinafter described, the banknotes are temporarily stored in the storage space of the pre-storage means 18. The banknotes are subsequently fed to the storage means 8 in precise synchronism with the movable belts 11 and 13 of the storage means 8.

The pre-storage means 18 includes a fourth belt 182 which extends between end reel 184 and storage reel 186 over a guide roller 188. The upper run 1811 of a transport path 181 extends from an outfeed opening 19 to the pre-storage means 18, while a bottom or lower run 1812 of the path 181 extends from a second path selector means 26 to a cassette module 44 when a third path selector means 36 is in a second position, as indicated by dotted lines designated by the numeral 362 in FIG. 3, and back to the outfeed opening 19 when the third selector means 36 is in a first position, as indicated by solid lines designated by the numeral 361. When the second path selector means 26 is in a second position, as indicated by dotted lines designated by the numeral 262, thin or valuable documents can be fed from the storage means 8 to the storage reel 184 for temporary storage. When the second selector means 26 is in a first position, as indicated by solid lines designated by the numeral 261, thin or valuable documents can be fed from the storage means 8 to the outfeed opening 19 of the arrangement 1 or to a collecting cassette 20 in the cassette module 44, depending on the position to which the third path selector means 36 is set.

The foregoing has dealt with certain main operational features of the arrangement 1 and with certain main components of the arrangement 1. Use of the aforedescribed illustrative embodiment of the arrangement 1 in practice will now be described in more detail.

The process module 41 includes the infeed opening 17, the outfeed opening 19, banknote straightening and positioning means 411 which functions to straighten crooked or wrongly positioned banknotes on the transport path, detector 412 for identifying the type of banknote concerned, banknote jerking or pulling means 413, and transport means 414 for returning banknotes to the outfeed opening 19.

The process module 41 is used to separate banknotes from a bundle of mixed banknotes placed in the infeed opening 17 and to transport the separated banknotes to the detector 412, one after the other in order to establish the value of the banknotes, and thereafter deliver identified banknotes to the pre-storage module 42 or return non-accepted banknotes to the outfeed opening 19.

The banknotes are separated at a rate of about five banknotes per second, and are transported lengthwise, i.e. with a short side leading, and then adjusted to a correct or desired position in the banknote straightening and positioning means 411 and detected in the detector 412. Unaccepted banknotes are transported past the banknote jerking means 413, while accepted banknotes are jerked or pulled down to the pre-storage module 42 crosswise, i.e. with a long side leading.

The pre-storage module 42 includes the transport path 181 with its upper and lower runs 1811 and 1812, the storage reel 184, the end reel 186, the guide roller 188, the storage belt 182, and the second and third path selector means 26 and 36.

The pre-storage module 42 is used to temporarily store banknotes that are received from the process module 41, and is able to store a small quantity of banknotes, twenty for example. The pre-storage module 42 is also used to temporarily store banknotes that are received from the main storage means 8 when it is desired to reorganize the space in the storage means 8, for instance to eliminate empty spaces in the belt 11 and thereby reduce access times. The pre-storage module 42 is also used to transport banknotes to the outfeed opening 19 or to the collecting cassette 20.

Banknotes received either from the process module 41 via the banknote jerking or pulling means 413 or from the main storage module 43 are stored on the storage reel 184. The storage reel 184 is light-weight and can be started when the leading edge of a banknote is detected, to be stopped when the trailing edge of the banknote is detected, and to process the banknotes at a rate of approximately five banknotes per second. Transportation of banknotes to the storage means 8 is controlled by signals from a processor 435 of the main storage module 43. When the arrangement 1 is activated, a banknote is first fed out from the storage reel 184 and stopped at point "A". The storage reel 184 and the end reel 186 begin rotating in anti-clockwise or opposite directions in response to a synchronizing signal from the processor 435 of the module 43 and the banknote is transported to an empty storage position or station of the storage means 8. The storage reel 184 and the end reel 186 cease to rotate when the leading edge of the next banknote reaches the point "A", and await a new synchronizing signal from the module 43, and so on. When all banknotes have been fed out from the storage reel 184, the belt 182 is fed back onto the storage reel 184 to receive additional banknotes. The acceleration and speed of the belts 11, 13 and 182; the position of the point "A"; and the time at which the belt 182 is activated are selected whereby an incoming banknote will correctly or accurately arrive in a given position or station on the belt 11. The positions or stations can be determined, for instance, by means of a digital code provided along one side edge of the belt 11, with several signals being placed along the length, fifteen centimeters for example, of the position or station, and with a different kind of signal provided at the border between two adjacent positions or stations. This allows the processor 435 of the main storage module 43 to store information related to the type of banknote stored in respective positions or stations.

It is to be understood that the positions or stations do not necessarily have the same length. Lengths of the positions or stations may be adapted to the length of banknotes to be stored, including a bundle of banknotes of different sizes, with the requisite distance between the banknotes naturally being taken two and two.

Banknotes arriving from the storage means 8 are normally transported to the outfeed opening 19 in the process module 41, i.e. through or during a normal dispensing transaction. If it is necessary to reorganize banknotes in the storage means 8, the banknotes are guided to the storage reel 184 by the path selector means 26 in the second position 262. The banknotes are then transported back to separate, empty storage positions or stations in the storage means 8 under the control of signals from the processor 435 of the main storage module 43.

In the event that the storage means 8 must be emptied or in the event that more space is required for the infeed of banknotes, the path selector means 36 located close to the outfeed opening 19 is switched to the second position 362 to thereby guide banknotes to the cassette 20.

The main storage module 43 includes the belt reels 111, 112, 123 and 124; the guide rollers 125, 126, 127 and 128; the belts 11, 12 and 13; the path selector means 16 and a banknote straightening and positioning means 421.

The main storage module 43 is used to store numerous banknotes, for example one thousand, of mixed denominations. The module 43 includes a broad, coded belt, constructed of plastic or other suitable material, having sufficient length and divided into numerous coded positions or stations as aforesaid, such as a length of approximately one hundred twenty meters and one thousand positions or stations for example, with space for one banknote in each of the positions or stations as aforesaid.

The position of the path selector means 16 determines whether banknotes are transported between the reels 111 and 112, or upwardly between the belts 12 and 13 toward the second path selector means 26. The normal position of the path selector means 16 is the position 161 shown in solid lines in FIG. 3. The banknote positioning means 421 determines the position of each banknote in a respective position or station and corrects any deviation from a desired position as the belt 11 moves there along. A memory in the processor 435 of the module 43 stores information as to which of the positions or stations contain banknotes and as to the denominations thereof.

When an infeed function is initiated, the belt 11 is activated and moves continuously from the belt reel 111 to the belt reel 112. The path selector means 16 is in the position 161. The position or station code on the belt 11 is read or monitored until an unoccupied position or station is detected, at which time a synchronizing signal is sent to the pre-storage module 42. Received banknotes pass the path selector means 16 and thereafter pass between the belts 11 and 13 to the belt reel 112. The belt 11 is stopped when all banknotes have been received.

The module 43 is controlled to hold the majority of stored banknotes on the belt reel 112, while the belt reel 111 contains mainly empty positions or stations.

When initiating the outfeed or dispensing function, the belt 11 is activated and moved from the belt reel 112 to the belt reel 111. Information from the processor memory 435 indicates which positions or stations contain requested denominations. When a desired banknote denomination, or value, is encountered or located, the path selector means 16 is caused to briefly assume the position 162 (dotted lines). The selector 16 captures the banknote in the selected position or station on the belt 11 and guides the banknote to the pre-storage module 42. Banknotes in unselected positions or stations pass beneath the selector means 16 as the means 16 is in the position 161 (full lines). The banknotes are stored on the belt reel 111 between the belts 11 and 12. The belt 11 is stopped when all requested banknotes have been removed from the belt 11. The empty stations on the belt 11 created by the withdrawal of banknotes can now be used in a subsequent transaction for storing new banknotes received from the pre-storage module 42.

The cassette module 44 is used for receiving banknotes from the storage means 8, either when emptying the means 8 or when the quantity of banknotes contained in the means 8 exceeds a predetermined quantity or when the quantity of banknotes of a given denomination, or value, exceeds a pre-determined quantity. The cassette 20 can contain numerous banknotes, up to fifteen hundred for example.

The infeed and outfeed functions have hereinbefore been described as mutually separate procedures. The arrangement 1, however, can perform a combined procedure. For example, the arrangement 1 may receive a mixed bundle of banknotes, verify the denominations thereof, calculate the total sum of the banknotes, and temporarily pre-store the banknotes. The arrangement 1 then feeds out the difference between banknotes taken from different positions or stations of the storage means 8 and feeds the pre-stored banknotes into the means 42. A customer desiring to deposit SEK 800 inputs this sum through the command means 10, such as by a keypad, and places a banknote having a value of SEK 1,000 in the infeed or deposit opening 17. The arrangement 1 feeds SEK 200 to the outfeed opening 19 and stores SEK 1,000 in the storage means 8.

Figure 4:
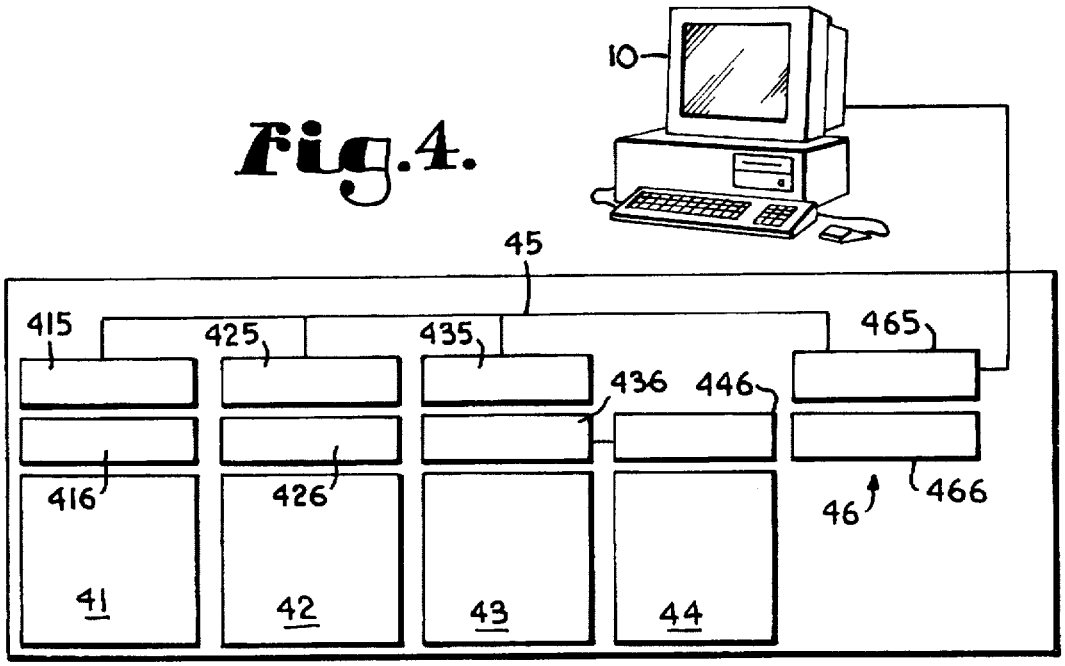
FIG. 4 is a partial schematic representation of the arrangement for the infeed and outfeed of valuable documents, illustrating software and operating structure thereof, according to the present invention.

Each of the three modules 41, 42 and 43 may have an individual processor 415, 425 or 435 loaded with software. Each of the three modules 41, 42 and 43 may also have electronic means 416, 426 and 436, as schematically indicated in FIG. 4, for controlling the various operating processes. The cassette module 44 similarly nay have electronic means 446. The various processors and electronic means are connected to the command means 10 over a local network 45 having a communication unit 46, processor means 465 and electronic means 466.

The banknote straightening and repositioning means 421 is preferably of the kind described and illustrated in Swedish patent application 9,501,181-3 which is incorporated herein by reference.

It is to be understood that while certain forms of the present invention have been illustrated and described herein, it is not to be limited to the specific forms or arrangement of parts described and shown.

What is claimed and desired to be secured by Letters Patent is as follows:

1. An arrangement for the infeeding and outfeeding of valuable documents, such as banknotes, cheques, and the like, comprising command means for externally controlling the functions of said arrangement and storage means for storing the documents fed into said arrangement between mutually coacting belts, characterized in that for the storage of the documents externally fed into said arrangement, said storage means is allocated predetermined document storage positions intended for the incoming documents, wherein said arrangement is further characterized by detector means located on an input side of said arrangement and functioning to identify each of the incoming documents prior to the storage of the documents in unoccupied ones of said predetermined positions of said storage means; memory means for storing information relating to respective said positions of the incoming documents in said storage means; a processor for storing in said memory means information received from said detector means and information relating to said predetermined positions in which the documents are stored; and path selector means which, when in a first position, enables the documents to be fed to said storage means and which, when in a second position, enables, in accordance with information obtained from said memory means, the documents earlier stored in said document storage means to be dispensed from said arrangement in response to a command entered through said command means, wherein said arrangement is able to receive a mixture of different documents on each infeed occasion and to dispense on each outfeed occasion a desired number and desired type of the documents predetermined through said command means.

2. The arrangement according to claim 1, characterized in that said storage means includes a first belt which is intended to be coiled onto and uncoiled from a first belt reel and uncoiled from and coiled onto a second belt reel depending on whether the documents are to be fed-out or fed-in; a second belt which is intended to be coiled onto and uncoiled from said first belt reel together with said first belt; and a third belt which is intended to be uncoiled from and coiled onto said second belt reel together with said first belt, wherein said second and third belts together form a document infeed/outfeed opening in which said path selector means, in said first position, enables the documents fed into said arrangement to be stored between said first belt and one of the two remaining ones of said belts and, in said second position, enables the documents to be fed-out from respective said storage positions between said first belt and said third belt.

3. The arrangement according to claim 2, characterized in that there is provided, between an externally accessible infeed opening of said arrangement and said storage means, a pre-storage means whose capacity is much smaller than a capacity of said storage means, wherein when the documents are fed into said arrangement, said pre-storage means functions to store the documents temporarily in storage spaces therein subsequent to any necessary straightening and repositioning and detection of the documents, and then to feed the documents to said storage means in precise synchronism with said belts of said storage means.

4. The arrangement according to claim 3, characterized in that said pre-storage means includes a fourth belt which is arranged to be coiled onto and uncoiled from a storage reel and uncoiled from and coiled onto an end reel; in that a transport path means extends between an externally accessible outfeed opening of said arrangement and said pre-storage means; and in that said pre-storage means and said transport path means together form a second infeed/outfeed opening in the close proximity of said first-mentioned infeed/outfeed opening, wherein there is arranged in said second infeed/outfeed opening a second multi-position path selector means which, when in a second position, enables the documents to be fed from said storage means to said storage reel for temporary storage.

5. The arrangement according to claim 4, characterized in that when in a first position, said second path selector means enables the outfeed of the documents for storage in said storage means and the outfeed of the documents from said storage means to said outfeed opening of said arrangement or to a collecting cassette, depending on which position a third multi-position path selector means having two positions is set.

6. A system for infeeding and outfeeding documents, comprising:

a) storage means including mutually coacting belts having predetermined stations for storing the documents;

b) detector means for identifying the documents prior to storage of the documents in unoccupied ones of said predetermined stations;

c) processor means including memory means for storing information received from said detector means regarding each of the documents and identity of said predetermined stations in which each of the documents is stored;

d) path selector means having:

1) a first position for directing infeeding ones of the documents to said storage means, and 2) a second position for dispensing outfeeding ones of the documents from said predetermined stations; and e) command means for externally controlling the dispensing of outfeeding ones of the documents from said storage means in response to said information stored in said memory means; and f) wherein said system in configured to operatively receive a mixture of different types of infeeding ones of the documents, and to operatively dispense a mixture of different types of outfeeding ones of the documents in response to said command means and said memory means.

7. The system according to claim 6, including:

a) said storage means having a first belt, a second belt, a third belt, a first belt reel and a second belt reel wherein said first belt is configured to be operatively reeled onto said first belt reel, together with said second belt, for storing infeeding ones of the documents, and said first belt is configured to be operatively reeled onto said second belt reel, together with said third belt, for storing infeeding and dispensing outfeeding ones of the documents; said second and third belts forming an infeed/outfeed opening; and b) said first position of said path selector means, in conjunction with said infeed/outfeed opening, directing infeeding ones of the documents between said first belt and one of said second and third belts and said second position of said path selector means, in conjunction with said infeed/outfeed opening, dispensing outfeeding ones of the documents from between said first and third belts.

8. The system according to claim 7, including:

a) an externally accessible infeed opening;

b) straightening means for straightening and repositioning infeeding ones of the documents; and c) pre-storage means, spaced between said externally accessible infeed opening and said storage means for temporarily storing infeeding ones of the documents from said straightening means and said detector means and for subsequently synchronously feeding those documents to said predetermined stations of said storage means.

9. The system according to claim 8, including:

a) an externally accessible outfeed opening;

b) transport path means for transporting the documents between said externally accessible outfeed opening and said pre-storage means;

c) said pre-storage means having a storage reel, an end reel, and a fourth belt configured to be operatively reeled onto said storage reel and said end reel; said pre-storage means and said transport path means forming a second infeed/outfeed opening; and d) second path selector means, in conjunction with said second infeed/outfeed opening, having:

1) a first position wherein ones of the documents are directed from said storage means to said externally accessible outfeed opening, and 2) a second position wherein ones of the documents are directed to and from said storage means and said pre-storage means.

10. The system according to claim 9, including:

a) a collecting cassette; and b) third path selector means, as said second path selector means assumes said first position thereof, having:

1) a first position for directing ones of the documents received from said second selector means to said externally accessible outfeed opening, and 2) a second position for directing ones of the documents received from said second selector means to said collecting cassette.

* * * * *